United States Patent [19]

Vollmer

[11] 4,452,184

[45] Jun. 5, 1984

[54] BOILER DRAFT CONTROL DEVICE

[75] Inventor: Rudolf Vollmer, Mosbach, Fed. Rep. of Germany

[73] Assignee: Honeywell-Braukmann GmbH, Mosbach, Fed. Rep. of Germany

[21] Appl. No.: 437,712

[22] Filed: Oct. 29, 1982

[30] Foreign Application Priority Data

Nov. 5, 1981 [DE] Fed. Rep. of Germany ..... 3143853
Feb. 6, 1982 [DE] Fed. Rep. of Germany ..... 3204179

[51] Int. Cl.[3] ..... F22B 37/46

[52] U.S. Cl. ..... 122/504.1; 110/188; 122/504; 236/45

[58] Field of Search ..... 122/4 R, 504; 110/103, 110/185, 186, 188, 190, 193; 236/99 K, 45; 98/86; 126/285 R, 286, 287.5

[56] References Cited

U.S. PATENT DOCUMENTS 1,884,794 10/1932 McKee ..... 236/99 K
2,031,652 2/1936 Hopping ..... 110/190
2,287,262 6/1942 Merry ..... 98/86
2,329,476 9/1943 Livingston ..... 98/86
2,774,541 12/1956 Eskin ..... 236/99 K
3,643,582 2/1972 Mochida ..... 98/86

*Primary Examiner*—Howard G. Favors
*Assistant Examiner*—Steven E. Warner
*Attorney, Agent, or Firm*—Clyde C. Blinn

[57] ABSTRACT

In order to protect a boiler against overheating a boiler draft control device comprises a safety thermostat in addition to the regular control thermostat. The control thermostat is provided with a supporting tube in order to limit its length reduction in the event of its failure. The safety thermostat is designed in such a manner that its working element only provides a displacement when the control range of the control thermostat is exceeded. Furthermore the safety thermostat has a very steep displacement/temperature characteristic and its maximum stroke is equal or greater than the stroke being given by an operable control thermostat over its total control range. A latch means is provided to prevent that an air inlet flap closed according to the response of the safety thermostat may be opened again with the cooling down of the boiler.

14 Claims, 3 Drawing Figures

BOILER DRAFT CONTROL DEVICE

The present invention relates to a boiler draft control device. Such boiler draft control devices preferably are used in connection with boilers fired by solid fuels. Herewith a control thermostat sensing the boiler temperature or the flow line temperature, respectively, operates against a push rod biased by a spring against the control thermostat. The push rod is displaceable against the spring by the control thermostat when the boiler becomes heated. A device is provided in order to convert the displacement of the push rod into a movement of an air inlet flap.

In order to prevent damage to the expensive boiler caused by excessive heat which would arise if the control thermostat fails and the air inlet flap will not close at high boiler temperatures, it has already been proposed to provide such boiler draft controllers with a safety device. When the control thermostat fails, such a device insures closure of the air inlet flap and therefore avoids overheating of the boiler. Said safety device is provided as a soldered link which melts if a predetermined limit temperature is attained so that the air inlet flap may be closed. Under use of a soldered link an erroneous response is only prevented if the working temperature and the safety temperature are far away from each other. With a boiler this is not true so that the soldered link already becomes soft at a temperature at the end of the control range. This leads to uncertainties. Moreover a soldered link comprises a relatively high thermal dead time so that the increased boiler temperature only slowly can be reduced.

It is, therefore, the object of the present invention to improve a boiler draft control device of the above-mentioned type in such a way that with a cheap design the response of the safety device at a predetermined limit temperature is very quick, unambiguous and reliable. This shall also be true if the working temperature is only less below the safety temperature. This object is achieved according to the invention as claimed in claim 1. Further advantageous embodiments of the invention may be taken from the sub-claims.

Figure 1:
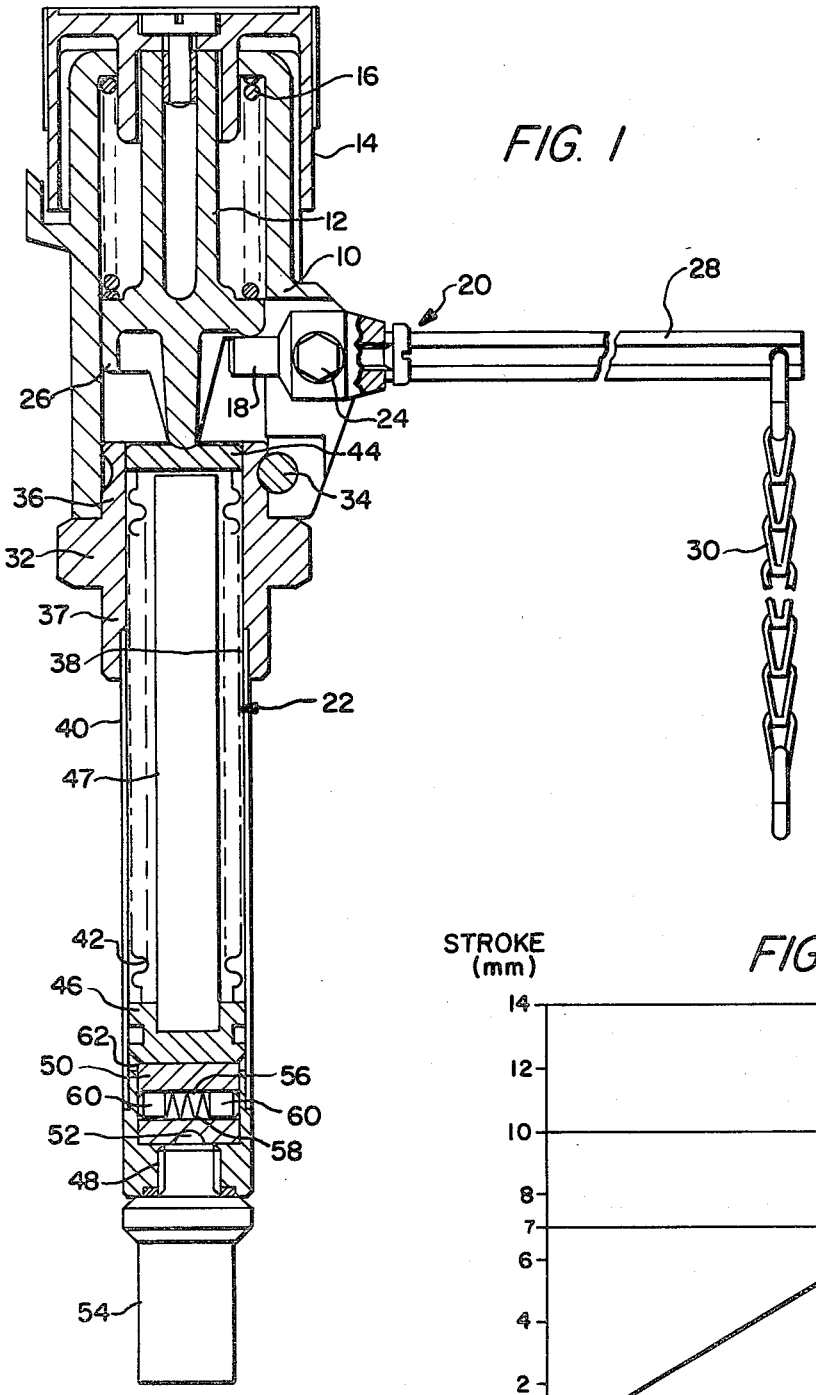
Figure 2:
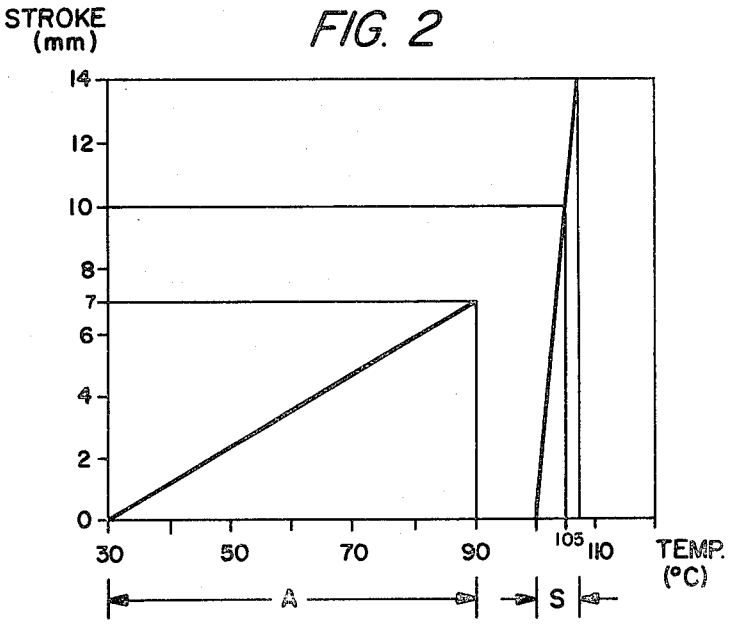
Figure 3:
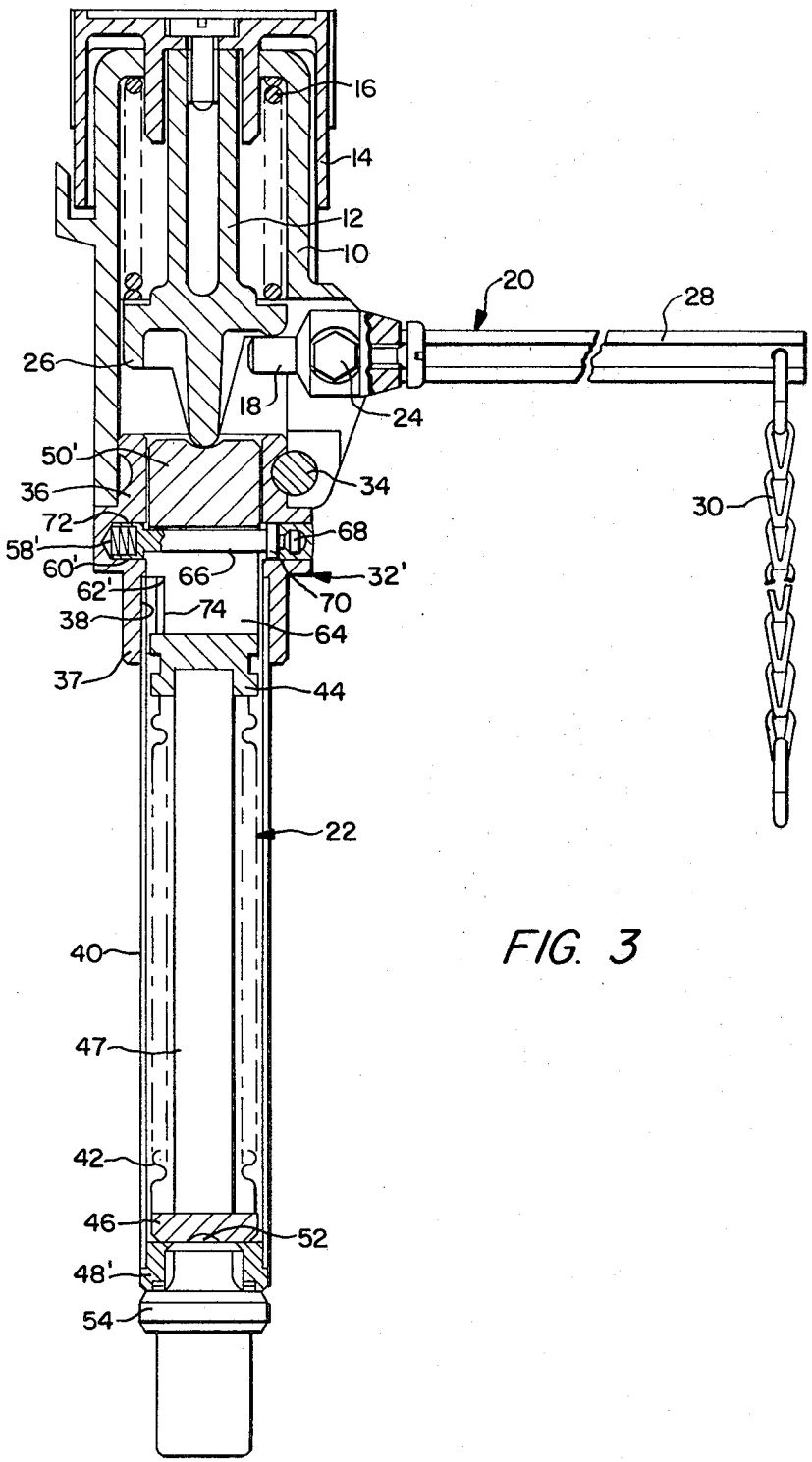

Under reference to the figures of the attached drawings in the following, embodiments of the present invention shall be further described. It shows:

FIG. 1 a longitudinal view of a first embodiment of the boiler draft control device according to the invention;

FIG. 2 a diagram showing the temperature/displacement characteristic of the thermostats; and FIG. 3 a longitudinal view of a second embodiment of the boiler draft control device according to the invention.

According to FIG. 1 a push rod 12 is rotatably supported in the center of a cylindrical housing 10 and is connected at its front end to a temperature setting knob 14. Between the push rod 12 and the housing 10 a coil spring 16 is arranged biasing the push rod 12 against an arm 18 of a lever 20 and against a control thermostat 22. The lever 20 is tiltably mounted at the housing 10 by means of a pivot pin 24. The one arm 18 of the lever 20 abuts against a sloped face 26 of the push rod 12 so that at rotation of the setting knob 14 and therefore of the push rod 12 the lever 20 is tilted. The other free arm 28 of the lever is connected to an air inlet flap (not shown) of a boiler by means of a chain 30.

A hexagonal nut 32 is connected to the housing 10, whereat a bolt 34 is inserted into a bore in the housing 10 and an annular groove at a cylindrical extension 36 of the hexagonal nut 32. The hexagonal nut 32 at its other end comprises an extension 37 with an external thread, and it is provided with a stepped interior bore 38 over its total length. An immersion shell 40 is tightly inserted into the interior bore 38 which adapts the control thermostat 22. Said control thermostat 22 comprises a metallic bellows 42 being filled with an expandable medium. The metallic bellows 42 is closed at the top by an upper piece 44 and is closed at the bottom by a bottom piece 46. The push rod 12 abuts against the upper piece 44. Within the metallic bellows 42 and between the upper piece 44 and the bottom piece 46 a supporting tube 47 is arranged which limits the length reduction of the control thermostat 22 at a failure of said thermostat which, e.g. is due to a leaky metallic bellows 42.

A U-shaped distance piece 48 is inserted from below into the immersion shell 40 and is connected to it. In the U-shaped cut out a distance piston 50 is displaceably arranged which on one hand abuts against the bottom piece 46 of the metallic bellows 42 and on the other hand against the actuating pin 52 of a safety thermostat 54 which is threaded from below into the distance piece 48. The distance piston 50 is provided with a diametral bore 56, whereat a compression spring in said bore urges two latch bolts 60 outwardly against the U-shaped cut out.

In the following the operation of the boiler draft controller as far as the safety device is concerned shall be described under reference to the diagram shown in FIG. 2.

With an operable control thermostat 22 the boiler draft controller operates in the usual manner which needs no detailed discussion. However, if the control thermostat 22 fails, because for instance the metallic bellows 42 becomes leaky, then even at high boiler temperatures the air inlet flap will be completely opened. In order to prevent this, first the supporting tube 47 is arranged in the metallic bellows 42 so that even with a leaky metallic bellows the length reduction of the control thermostat 22 is limited. Since in spite of this limited length reduction of the control thermostat 22 at a failure of the control thermostat an increased boiler temperature may not be prevented, the safety thermostat 54 is threaded into the distance piece 48 from behind. This safety thermostat 54 comprises a wax mixture changing into the liquid phase when the boiler temperature exceeds the control range which is normally within 30° C. and 90° C. The response temperature of the safety thermostat 54 according to FIG. 2 for instance is adjusted at 100° C. Since the displacement-/temperature characteristic of the safety thermostat is very steep for instance at 100° C., the operating pin 52 has made a displacement which is greater than the total displacement in the control range A made by an operable control thermostat 22. One may note from FIG. 2 that within the safety range S the operating pin 52 makes a stroke of 10 mm at an increase of the boiler temperature by 5° C. This displacement is greater than the total expansion of 7 mm made by the control thermostat 22 in the control range A.

If the safety thermostat 54 responds, the operating pin 52 displaces the distance piston 50 and via the supporting tube 46 the whole control thermostat 22 against the push rod 12 so that by means of the lever 20 and the chain 30 the air inlet flap is allowed to take its closed position. At a certain stroke of the distance piston 50 the latch bolts 60 urged by the spring 58 are outwardly displaced and abut against the shoulder 62 of the distance piece 48. Herewith in a desired manner the air inlet flap also remains closed at lowered boiler temperatures. After removing the housing 10 by removing the bolt 34 and after removal of the inoperable control thermostat 22, the distance piston 50 may be shifted into the shown position by a special tool. After insertion of an operable control thermostat 22, the boiler draft controller may be operated again.

According to FIG. 3 another embodiment of the present invention is shown where in the event of an actuated safety device, the latching of said device may be unlatched without a special tool and without disassembly of any parts. As far as components within the present embodiment correspond to components within the embodiment according to FIG. 1 they bear the same reference numbers. Modified components having the same function are provided with an apostrophe and newly added components are provided with differing reference numbers.

Under reference to FIG. 3 a hexagonal unit 32' is connected in the same manner to the housing 10 as it was connected in the embodiment according to FIG. 1. A distance piece 48' having the shape of a disk with a threaded hole is inserted from below into the immersion shell 40 and connected to it. The safety thermostat 54 is threaded into the disc 48' from below and is abutting with its operating pin 52 against the bottom piece 46 of the metallic bellows 42.

A distance piston 50' abuts against the upper piece 44 closing the upper end of the metallic bellows 42. At the opposite side the push rod 12 abuts against the distance piston 50'. From below a diametral groove 64 is cut into the distance piston 50'. A latch bolt 66 is inserted into the groove 64 and at one end is provided with an actuating knob 68 and at the other end is provided with a latch sleeve 60' with the knob and the sleeve having an increased diameter compared with the latch bolt 66. The actuating knob 68 is displaceably guided in a bore 70 in the hexagonal nut 32' and the latch sleeve 60' abuts against a spring 58' arranged in a blind hole 72. The blind hole 72 is coaxially arranged with respect to the bore 70 and worked into the hexagonal nut 32' from the interior bore. By means of a plane face 74 at the distance piston 50' parallel to its axis and in the area of the groove 64 adjacent to the latch sleeve 60'0 a shoulder 62' is formed against which the latch sleeve 60' abuts if the arrangement comprising the metallic bellows 42, the distance piston 50' and the push rod 12 is displaced to the top over a certain distance when the safety thermostat 54 responds. At a lowered boiler temperature the arrangement may be again displaced into the working position by displacing the latch bolt 66 and the latch sleeve 60' against the force of the spring 58' by pushing the actuating knob 68 so that the latch sleeve 60' does not further abut against the shoulder 62'. The coil spring 16 via the push rod 12 now displaces the whole arrangement comprising the distance piston 50' and the control thermostat 22 into the shown position in which position the control thermostat 22 abuts against the operating pin 52 of the safety thermostat 54.

It may be obvious for a person skilled in the art to provide other devices which prevent back shifting of the distance piston after its displacement by the safety thermostat. Further, it is possible to provide a distance piston without latch means; however, in this event the temperature of the boiler will be controlled by a temperature lying in the safety range S.

I claim:

1. A boiler draft control device comprising:

a housing containing a push rod, spring biased downward away from a temperature setting knob, lever means pivotally supported on said housing, said lever means having an output arm adapted to be connected to a boiler draft apparatus and a second arm abutting against a face of said push rod, an immersion shell adapted to be inserted into the boiler to be in contact with the boiler water, means connecting said immersion shell to said housing, control thermostat means having a control range and contained inside said shell between said push rod and a lower end of said immersion shell wherein said control thermostat means comprises means for increasing in length upon a change in temperature causing said push rod to move upward to operate said lever means, safety thermostat means having a sensitive range outside of the control range of said control thermostat means, and means connecting said safety thermostat means to said lower end of said immersion shell to override the effect of said control thermostat means by pushing upward to raise said lower end when an excessive high temperature exists in the boiler.

2. The invention of claim 1, wherein said control thermostat means comprises an expandable means filled with a temperature responsive expandable medium to increase in length as its temperature changes, and supporting means to limit its length reduction upon failure of said expandable medium.

3. Device according to claim 2, wherein said supporting means is arranged in said control thermostat in order to define the length of said control thermostat at failure.

4. Device according to claim 3, wherein said supporting means comprises a supporting tube in a metallic bellows of said control thermostat.

5. Device according to claim 1, wherein said safety thermostat comprises an element filled with wax, wherein said wax changes to the liquid phase when exceeding a temperature above the control range.

6. Device according to claim 5, wherein said safety thermostat has an essentially steeper displacement/temperature characteristic than said control thermostat.

7. Device according to claim 6 wherein said safety thermostat has a stroke equal to or greater than the stroke of said control thermostat.

8. Device according to claim 5 comprising latch means preventing reverse displacement of the push rod under spring action upon actuation of said safety thermostat with said control thermostat being threaded into the boiler by means of a hexagonal nut, wherein the latch means is provided in the hexagonal nut and may be unlatched by means of an actuating knob being accessible from the outside of the nut.

9. The invention of claim 1 wherein said means connecting said safety thermostat means is a distance piston movable by said safety thermostat and supporting said control thermostat means.

10. Device according to claim 9, wherein the distance piston is displaceable in a cylindrical piece and comprises latch means cooperating with the interior wall of the cylindrical piece, with said latch means allowing displacement of the distance piston towards the safety position but not back from said position.

11. Device according to claim 10, wherein the latch means comprises two latch bolts arranged in a diametral bore within the distance piston and biased by a spring which latch bolts abut against a shoulder when the distance piston is displaced by said safety thermostat.

12. Boiler draft control device comprising a control thermostat sensing the boiler temperature or the flow line temperature, respectively, and a push rod biased by a spring against the control thermostat, said push rod being displaceable against the spring when the control thermostat becomes heated, further comprising a device for converting the displacement of the push rod into a motion of an air inlet flap and a safety device responsive to an excessive heat for closing the air inlet flap at the exceeding of a predetermined control range, wherein the safety device comprises a safety thermostat connected in series to the control thermostat and having a sensitive range lying outside of the control range of the control thermostat, comprising latch means preventing reverse displacement of the push rod under spring action at actuated safety thermostat with the thermostat configuration being threaded into the boiler by means of a hexagonal nut, wherein the latch means is provided in the hexagonal nut and may be unlatched by means of an actuating knob being accessible from the outside of the nut, and comprising a distance piston which includes parts of the latch means, wherein the distance piston is displaceably arranged between the control thermostat and the push rod within the hexagonal nut and contains a diametral groove cut in from the bottom end and wherein a latching bolt is arranged in said groove, which bolt is biased by a spring and cooperates with a shoulder.

13. Device according to claim 12, wherein the latch bolt is connected to the actuating knob and comprises a latching sleeve at its front end which abuts via a spring in a blind hole and wherein the actuating knob is guided in a bore within the hexagonal nut with said bore being diametral to said blind hole.

14. Device according to claim 13, wherein the distance piston comprises a plane face in the area of said groove and parallel to its axis in order to form said shoulder behind which the latching sleeve slips after a displacement of the distance piston.

* * * * *